US005421488A

United States Patent [19]

Ehrbar

[11] Patent Number: 5,421,488

[45] Date of Patent: Jun. 6, 1995

[54] SQUEEZE BOTTLE FOR DISPENSING VISCOUS LIQUIDS

[76] Inventor: James J. Ehrbar, 730 N. Racine Cir., Mesa, Ariz. 85205

[21] Appl. No.: 261,762

[22] Filed: Jun. 17, 1994

Related U.S. Application Data

[63] Continuation of Ser. No. 52,577, Apr. 23, 1993, abandoned.

[51] Int. Cl.[6] ..... B05B 11/04

[52] U.S. Cl. ..... 222/185; 222/212; 222/482; 222/556; 215/2

[58] Field of Search ..... 222/482, 173, 184, 556, 222/212, 185, 481, 545, 534, 215, 206, 179.5; 215/2, 6, 10, 235

[56] References Cited

U.S. PATENT DOCUMENTS

| | | | |
|---|---|---|---|
| 1,635,070 | 7/1927 | Clark | 215/2 |
| 1,660,606 | 2/1928 | Evans | 215/2 X |
| 1,740,522 | 12/1929 | Pickering | 220/255 |
| 1,836,521 | 12/1931 | Baron | 215/235 |
| 2,036,407 | 4/1936 | Godfrey | 215/2 X |
| 2,626,647 | 1/1953 | Barton | 222/215 |
| 3,482,801 | 12/1969 | Leontas | 220/255 X |
| 4,645,097 | 2/1987 | Kaufman | 222/212 X |
| 4,781,314 | 11/1988 | Schoonover et al. | 222/482 X |
| 4,923,098 | 5/1990 | Schoonover et al. | 222/482 X |
| 4,928,860 | 5/1990 | Knight | 222/184 X |
| 5,033,655 | 7/1991 | Brown | 222/212 |
| 5,083,671 | 1/1992 | Hayes | 215/235 X |
| 5,141,136 | 8/1992 | Tignor | 222/212 |

FOREIGN PATENT DOCUMENTS

| | | | |
|---|---|---|---|
| 2227580 | 1/1974 | Germany | 222/215 |
| 4006193 | 8/1991 | Germany | 215/2 |
| 886431 | 1/1962 | United Kingdom | 215/2 |

*Primary Examiner*—Andres Kashnikow
*Assistant Examiner*—Lisa Douglas
*Attorney, Agent, or Firm*—William E. Hein

[57] ABSTRACT

A squeeze bottle for dispensing viscous liquids of the type having a conventional opening and associated flip lid at the top thereof is provided with a second opening and associated flip lid positioned adjacent the bottom of the squeeze bottle so that the contents remaining when the bottle is nearly empty may be easily dispensed therefrom. Alternatively, the conventional top opening and flip lid may be eliminated and a single opening provided adjacent the bottom of the squeeze bottle. In another embodiment, a squeeze bottle is symmetrically configured to have flip lids of sufficient surface area at each end thereof to permit storage of the squeeze bottle on either end so that the contents may be easily dispensed from the flip lid on which the squeeze bottle rests during storage.

1 Claim, 1 Drawing Sheet

SQUEEZE BOTTLE FOR DISPENSING VISCOUS LIQUIDS

This application is a continuation of application Ser. No. 08/052,577, filed Apr. 23, 1993, now abandoned.

BACKGROUND AND SUMMARY OF THE INVENTION

This invention relates generally to squeeze bottles of the type commonly used to dispense viscous liquid contents such as catsup, mustard, shampoo, etc. and, more particularly, to such bottles in which an opening is provided at both the top and bottom thereof or just at the bottom.

Conventional squeeze bottles for containing and dispensing such viscous liquids as catsup, mustard, shampoo, salad dressing, etc. typically have a single opening located at the top of the bottle. When the contents of such squeeze bottles have been partially consumed, it is necessary for the user to shake the bottle several times in its upside down position until the contents reach the opening. This process becomes more time consuming and frustrating when the bottle is nearly empty. In fact, it is nearly impossible to completely empty such squeeze bottles unless the user is willing to balance the bottle upside down on its lid and wait for several minutes or longer for the contents to gravitate to the opening.

It is therefore the principal object of the present invention to provide a squeeze bottle for containing and dispensing viscous liquids in which the contents may be quickly and easily dispensed when the bottle is nearly empty without turning the bottle upside down.

This and other objects are accomplished in accordance with the illustrated preferred embodiment of the present invention by providing a squeeze bottle having a second opening positioned adjacent the bottom of the bottle. In another embodiment, the opening conventionally provided at the top of the squeeze bottle is eliminated and a single opening is provided adjacent the bottom of the squeeze bottle. In yet another embodiment, the squeeze bottle is symmetrically configured to have flip lids of sufficient surface area covering openings at each end thereof to permit storage of the squeeze bottle on either end so that the contents may be easily dispensed from the flip lid on which the squeeze bottle rests during storage.

Detailed Description of the Preferred Embodiments

Figure 1:
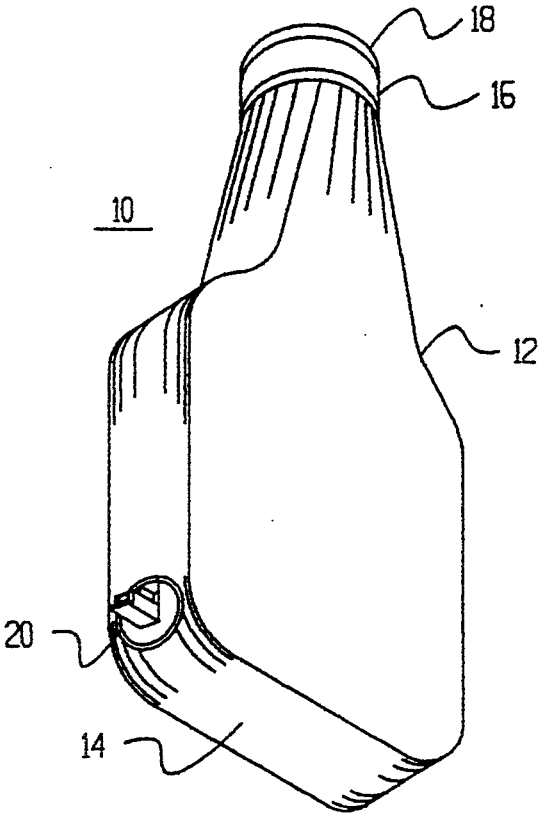
FIG. 1 is a pictorial diagram illustrating a squeeze bottle constructed in accordance with one preferred embodiment of the present invention in which a second opening is provided adjacent the bottom of the squeeze bottle.

Referring now to FIG. 1, there is shown a squeeze bottle 10 of the type that may be used for containing and dispensing a viscous liquid such as catsup, for example. Bottle 10 includes a shaped body 12, including a flat bottom surface 14 on which bottle 10 rests when in a storage position. An end cap 16, with an associated conventional flip lid 18, covers a top opening of the bottle 10 such that flip lid 18 may be opened when it is desired to dispense catsup from squeeze bottle 10. A second opening, covered by a conventional flip lid 20, is provided on a side surface of body 12 adjacent bottom surface 14 to permit the user to dispense catsup therefrom. By providing flip lid 20 adjacent the bottom of squeeze bottle 10, the user may easily dispense the catsup that remains in bottle 10 when it is nearly empty, without the need for shaking the bottle in its upside down position in order to dispense from flip lid 18. Since the squeeze bottle 10 rests on its bottom surface 14 when being stored, any catsup remaining when squeeze bottle 10 is nearly empty will gravite to the bottom thereof.

In accordance with an alternative cost-saving embodiment of the present invention, flip lid 18 may be eliminated from squeeze bottle 10 so that the catsup contained therein is dispensed only from flip lid 20 adjacent the bottom of squeeze bottle 10.

Figure 2:
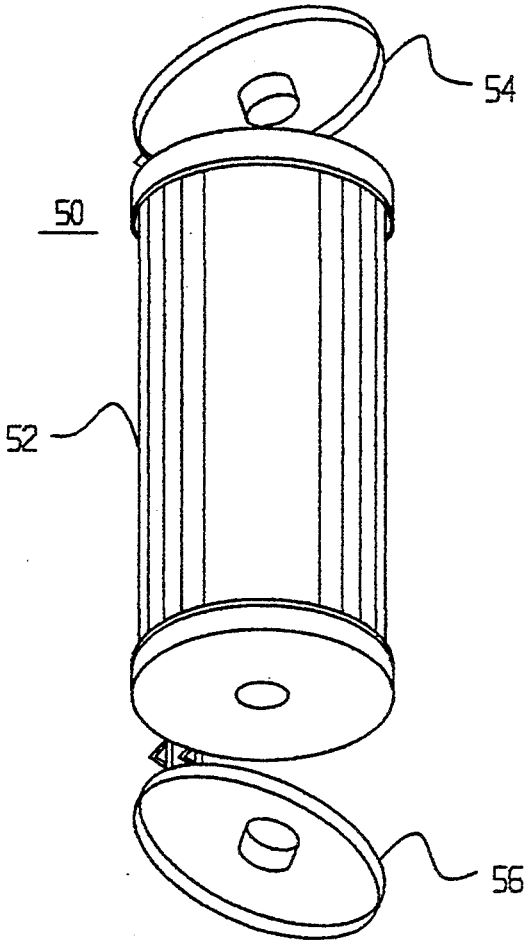
FIG. 2 is a pictorial diagram illustrating a squeeze bottle constructed in accordance with an alternative embodiment of the present invention in which the bottle is configured symmetrically with end cap openings on the top and bottom surfaces, thereby permitting the bottle to be stored on either end and the contents dispensed from either end.

Referring now to FIG. 2, there is shown another embodiment of the present invention in which a squeeze bottle 50 includes a shaped body 52 and symmetrical flip lids 54, 56 covering openings at each end of the body 52 so that the contents of bottle 52 may be dispensed from openings on either end thereof. Preferably, each of the flip lids 54, 56 is of sufficient surface area to permit squeeze bottle 50 to rest thereon while being stored. Regardless of which of flip lids 54, 56 squeeze bottle 50 rests on while being stored, the contents will of course gravitate to that flip lid for easy dispensing.

I claim:

1. A squeeze bottle for containing and dispensing a viscous liquid, the squeeze bottle comprising:

a cylindrically shaped flexible body;

first opening cap means at one end of the cylindrically shaped flexible body, said first opening cap means including a hinged cap member having a flat surface of substantially equal area to a cross-sectional area of said cylindrically shaped flexible body to permit storage of said squeeze bottle on said flat surface of said hinged cap member said first opening cap means being manually openable and closable by a user for selectively dispensing the viscous liquid therefrom; and second opening cap means at an opposite end of the cylindrically shaped flexible body, said second opening cap means being symmetrical with respect to said first opening cap means and including a hinged cap member having a flat surface of substantially equal area to said cross-sectional area of said cylindrically shaped flexible body to permit storage of said squeeze bottle on said flat surface of said hinged cap member of said second opening cap means, said second opening cap means being manually openable and closable by the user for selectively dispensing the viscous liquid therefrom.

* * * * *